United States Patent [19]

Marx et al.

[11] Patent Number: 4,606,496

[45] Date of Patent: Aug. 19, 1986

[54] RIGID PAPERBOARD CONTAINER

[75] Inventors: Ronald P. Marx, Lakewood; Patrick H. Wnek, Menasha; Denny R. Grans, Appleton, all of Wis.

[73] Assignee: James River Corporation of Virginia, Norwalk, Conn.

[21] Appl. No.: 777,873

[22] Filed: Sep. 20, 1985

Related U.S. Application Data

[63] Continuation of Ser. No. 591,557, Mar. 20, 1984, abandoned.

[51] Int. Cl.[4] ..... B65D 1/00

[52] U.S. Cl. ..... 229/2.5 R; 229/5.8

[58] Field of Search ..... 229/2.5 R, 5.8

[56] References Cited

U.S. PATENT DOCUMENTS

| | | |
|---|---|---|
| 199,370 | 1/1978 | Kearns . |
| 308,098 | 11/1884 | Robertson . |
| 1,627,051 | 5/1927 | Moore . |
| 1,668,101 | 5/1928 | Bothe . |
| 1,748,865 | 2/1930 | Chaplin . |
| 2,014,297 | 9/1935 | Rutledge . |
| 2,125,793 | 8/1938 | Linderman, Jr. . |
| 2,163,585 | 6/1939 | Chaplin . |
| 2,251,243 | 7/1941 | Randall . |
| 2,305,998 | 12/1942 | Simmons . |
| 2,348,725 | 5/1944 | Chaplin . |
| 2,832,522 | 4/1958 | Schlanger . |
| 2,997,927 | 8/1961 | Carson . |
| 3,033,434 | 5/1962 | Carson . |
| 3,305,434 | 2/1967 | Bernier et al. . |
| 3,315,018 | 4/1967 | Commeyras . |
| 3,401,863 | 9/1968 | Earl . |
| 3,468,468 | 9/1969 | Foote . |
| 3,684,633 | 8/1972 | Haase . |
| 3,792,809 | 2/1974 | Schneider et al. . |
| 4,026,458 | 5/1977 | Morris et al. . |
| 4,149,841 | 4/1979 | Patterson . |

FOREIGN PATENT DOCUMENTS

| | | |
|---|---|---|
| 981667 | 4/1965 | United Kingdom . |

*Primary Examiner*—Joseph Man-Fu Moy

*Attorney, Agent, or Firm*—Finnegan, Henderson, Farabow, Garrett & Dunner

[57] ABSTRACT

This invention is a paperboard container comprising a bottom wall, an upwardly extending side wall, a first curved portion joining the side wall to the periphery of the bottom wall, an outwardly extending rim, a second curved portion joining the rim to the periphery of the side wall, and a downwardly curved lip outwardly extending from the periphery of the rim. The container is integrally formed from a substantially homogeneous paperboard blank by a press such that the thickness of the side wall, second curved portion and rim is less than that of the bottom wall, first curved portion and lip. The container includes a plurality of densified regions radially extending through and circumferentially spaced about annular sections of the side wall, second curved portion and rim. The densified regions are formed from pleats including at least three layers of paperboard created during press forming of the blank which are subjected to sufficient pressure to reform the pleats into cohesive, fibrous structures having a density substantially greater than and a thickness substantially equal to adjacent areas of the side wall, second curved portion and rim.

27 Claims, 8 Drawing Figures

RIGID PAPERBOARD CONTAINER

This application is a continuation of application Ser. No. 591,557, filed Mar. 20, 1984, now abandoned.

BACKGROUND OF THE INVENTION

1. Field of Invention

This invention pertains generally to the field of processes for forming pressed paperboard products such as paper trays and plates and to the products formed by such processes.

2. Description of the Prior Art

Formed fiber containers, such as paper plates and trays, are commonly produced either by molding fibers from a pulp slurry into the desired form of the container or by pressing a paperboard blank between forming dies into the desired shape. The molded pulp articles, after drying, are fairly strong and rigid but generally have rough surface characteristics and are not usually coated so that they are susceptible to penetration by water, oil and other liquids. Pressed paperboard containers, on the other hand, can be decorated and coated with a liquid-proof coating before being stamped by the forming dies into the desired shape. Pressed paperboard containers generally cost less and require less storage space than the molded pulp articles. Large numbers of paper plates and similar products are produced by each of these methods every year at relatively low unit cost. These products come in many different shapes, rectangular or polygonal as well as round, and in multicompartment configurations.

Pressed paperboard containers tend to have somewhat less strength and rigidity than do comparable containers made by the pulp molding processes. Much of the strength and resistance to bending of a plate-like container made by either process lies in the side wall and rim areas which surround the center or bottom portion of the container. When in use, such containers are supported by the rim and side wall while the weight held by the container is located on the bottom portion. Thus, the rim and side wall generally is placed in tension when the container is being used.

In plate-like structures made by the pulp molding process, the side wall and overturned rim of the plate are unitary, cohesive fibrous structures which have good resistance to bending as long as they are not damaged or split. Because the rim and side wall of the pulp molded containers are of a cohesive, unitary structure, they may be placed under considerable tension without failing.

In contrast, when a container is made by pressing a paperboard blank, the flat blank must be distorted and changed in area in order to form the blank into the desired three dimensional shape. This necessary distortion results in seams or pleats in the sidewall and rim, the areas of the container which are reduced in press forming the container. These seams or pleats constitute material fault lines in the side wall and rim areas about which such containers bend more readily than do containers having unflawed side walls and rims. Moreover, such seams or pleats have a tendancy to return to their original shape—flat. The necessary location of these pleats in the side wall and rim of pressed paperboard containers places the greatest weakness in the area requiring the greatest strength. Such containers have been unable to support loads comparable to pulp molded containers since, when in use, the greater the load the higher the tension imposed on the rim and side wall. Imposing tension on pleats merely enhances the tendancy to flatten. Accordingly, known pressed paperboard containers have significantly less load carrying ability than do pulp molded containers. A pressed paperboard plate being less costly than its pulp molded competitor would have significant commercial value if it had comparable strength and rigidity.

Many efforts have been made to strengthen pressed paperboard containers while accommodating the necessary reduction in area at the side walls and rims. Blanks from which paperboard containers are pressed have been provided with score lines at their periphery to eliminate the random creation of seams or pleats. The score lines define the locations of the seams or pleats. Score lines, sometimes in conjunction with special die shapes, have been used to create flutes or corrugations in the sidewall and rim for aesthetic and structural purposes. The additional cost and complexity of dies used to create flutes or corrugations in the side wall of such containers is a cost disadvantage, and the containers are not significantly more rigid than prior paperboard containers.

Whether the area reduction of the side wall and rim is accommodated by pleats, seams, flutes or corrugations, the basic difficulty has been that under limited stress the paperboard will tend to return to its original shape.

To overcome this tendency, it has been suggested that the rim be subjected to various strengthening techniques. The earliest efforts comprised the addition of several thicknesses of paperboard at the rim. This container, however, required additional manufacturing steps and increased the cost and required storage space of the containers. Examples of this technique may be seen in Moore, U.S. Pat. No. 2,627,051, and Bothe, U.S. Pat. No. 2,668,101.

Wilson, British Pat. No. 981,667, teaches subjecting the lip or rim of the container to pressure greater than that imposed on the rest of the container in the belief that the additional compression would resist the tendency of the rim to return to its original shape. While the rim of the device of Wilson is flattened, the side wall of the container is corrugated presenting the disadvantages referred to above.

More recently, as disclosed in a commonly-assigned, copending U.S. application, Ser. No. 367,880, filed Apr. 13, 1982, improved rigidity in a pressed paperboard container has been achieved by application of pressure and temperature to the rim of the container while applying substantially no pressure to the sidewall and bottom wall. In particular, the container had a generally planar bottom wall, a side wall upwardly rising from the bottom wall periphery and an overturned rim extending from the sidewall periphery. During integrally press-forming of the container, substantially no pressure was applied to the bottom and side walls and pressure was applied to the overturned rim. The amount of pressure imposed on the rim was approximately 200–250 psi and gradually increased from the juncture of the rim and side wall to the peripheral edge of the rim. The pleats formed in the rim were compressed to the thickness of the rim while the pleats formed in the side wall were not subject to any significant pressure. The container thus formed provided a significant improvement over prior paperboard containers.

The present invention is a dramatic improvement over prior paperboard containers. The containers of the invention provide a 300% improvement in rigidity over earlier paperboard containers and approximately a 50% increase in rigidity over containers disclosed in U.S. application Ser. No. 367,880.

SUMMARY OF THE INVENTION

As embodied and broadly described herein, the invention is a paperboard container comprising a bottom wall, an upwardly extending side wall, a first curved portion joining the side wall to the periphery of the bottom wall, an outwardly extending rim, a second curved portion joining the rim to the periphery of the side wall, and a downwardly curved lip outwardly extending from the periphery of the rim. The container is integrally formed from a substantially homogeneous paperboard blank by a press such that the thickness of the side wall, second curved portion and rim is less than that of the bottom wall, first curved portion and lip. The container includes a plurality of densified regions radially extending through and circumferentially spaced about annular sections of the side wall, second curved portion and rim. The densified regions are formed from pleats including at least three layers of paperboard created during press forming of the blank which are subjected to sufficient pressure to reform the pleats into cohesive, fibrous structures having a density substantially greater than and a thickness substantially equal to adjacent areas of the side wall, second curved portion and rim.

Preferably, the bottom wall and rim of the container are generally planar and substantially parallel, and the side wall is substantially planar and is outwardly inclined to the bottom wall.

In a preferred embodiment, the thickness of the side wall is equal to that of the rim, and the thickness of the bottom wall is substantially equal to that of the blank.

Preferably the paperboard blank has a moisture content by weight of 4% to 12% and is pressed at a temperature between 200° F. and 400° F. The force applied by the press is preferably in the range of 6000 lbs to 30,000 lbs with a pressure in the range of 300 psi to 1500 psi being applied to the side wall, second curved portion and rim.

The paperboard blank may include a plurality of score lines at which pleats are formed and transformed into densified regions.

The invention is also directed to a method of forming containers from a flat, substantially homogeneous paperboard blank comprising shaping the blank into a formed container having a bottom wall, an upturned side wall extending from the bottom wall, a rim outwardly extending from the side wall and a lip downwardly extending from the rim and including pleats formed in the side wall, rim and lip. Sufficient heat and pressure are applied to the side wall and rim to decrease their thickness to less than the blank and to transform the pleats into cohesive fibrous structures having a density greater than and a thickness substantially equal to adjacent areas of the side wall and rim.

Preferably the container is pressed at a temperature of approximately 200° F. to 400° F., and the side wall and rim is subject to pressure in the range of 300 psi to 1500 psi.

The accompanying drawings, which are incorporated in and constitute a part of this specification, illustrate an embodiment of the invention, and, together with the description, serve to explain the principles of the invention.

DESCRIPTION OF THE PREFERRED EMBODIMENT

Reference will now be made in detail to the present preferred embodiment of the invention, an example of which is illustrated in the accompanying drawings.

In accordance with the invention, the paperboard container comprises a bottom wall, an upwardly extending side wall, a first curved portion joining the side wall to the periphery of the bottom wall, an outwardly extending rim, a second curved portion joining the rim to the periphery of the side wall, and a downwardly curved lip outwardly extending from the periphery of the rim.

The container of the invention may be circular, as in a plate or bowl, or it may be square or rectangular with annular corners, as in a tray. Other shapes are contemplated including compartmented trays or plates and oval platters. In each contemplated embodiment all corners are rounded or curved which are represented by the section depicted in FIG. 1

Figure 1:
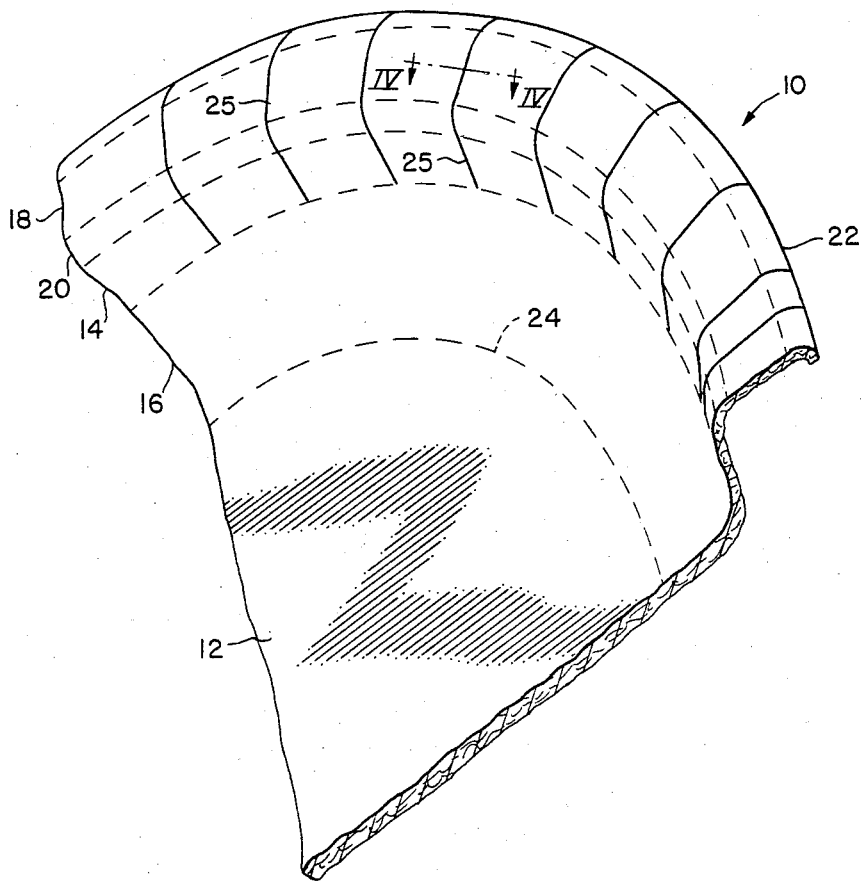
FIG. 1 is a perspective view of a section of a plate-like container in accordance with the invention.

In the preferred embodiment depicted in FIG. 1, container 10 comprises bottom wall 12, upwardly extending side wall 14, first curved portion 16 joining side wall 14 to the periphery of bottom wall 12, rim 18, second curved portion 20 joining rim 18 to the periphery of side wall 14, and a downwardly curved lip 22 outwardly extending from the periphery of rim 18. The phantom lines in FIG. 1 have been provided for ease in identifying the various structural segments of the container and do not represent lines actually appearing on the container. Moreover, the phantom lines do not represent actual demarcations between the segments; as explained below, in each embodiment the size relationships between the segments vary.

Figure 2:
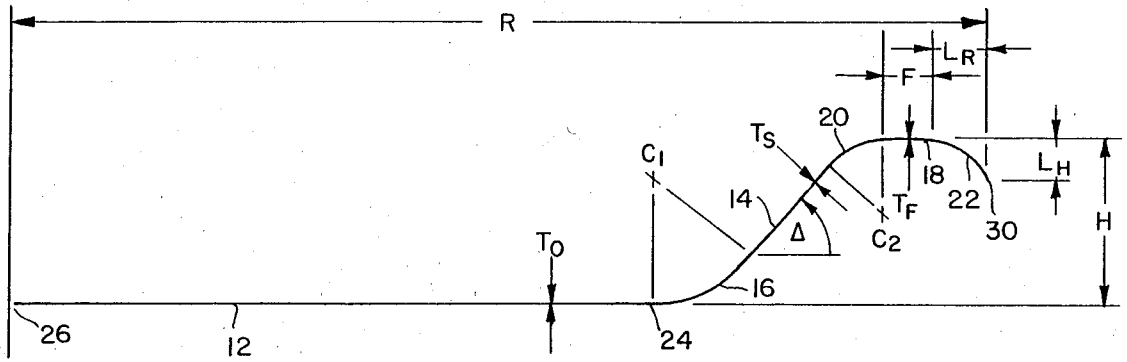
FIG. 2 is a graphic representation of the cross-sectional shape of one-half of the container of the invention.

As depicted in FIG. 2, bottom wall 12 is generally co-planar with an imaginary plane defined by its periphery 24. Bottom wall 12 may gradually diverge toward its center 26 from the periphery 24.

In the preferred embodiment, rim 18 is generally planar and generally parallel to a plane defined by the periphery 24 of bottom wall 12. Also, side wall 14 is generally planar and outwardly inclined to bottom wall 12.

As previously mentioned, the container of the invention may be embodied in various shapes and sizes. For example, the container may be circular plates having different diameters, bowls of different sizes, platters and trays. In each case, however, the container shape will conform to certain geometric relationships found to contribute to the improved rigidity. The general geometric shape providing such rigidity has been set forth above. Certain specific geometric factors, however, are useful in describing the various shapes contemplated by the subject invention.

In FIG. 2 the following designations are used:

R—the radial distance from the center 26 of bottom wall 12 to the distal end 30 of lip 22.

H—the axial height of rim 18 above a plane defined by the periphery 24 of bottom wall 12.

$C_1$—the radius of curvature of first curved portion 16.

$C_2$—the radius of curvature of second curved portion 20.

F—the radial width of rim 18.

$L_H$—the axial height of lip 22

$L_R$—the radial width of lip 22.

$T_o$—the average thickness of bottom wall 12.

$T_s$—the average thickness of side wall 14.

$T_F$—the average thickness of rim 18

Δ—the angle of inclination of side wall 14 to bottom wall 12.

Using the geometric factors depicted in FIG. 2, the annular portions of the contemplated shapes of the invention preferably fall within the following ranges.

$$R=2 \text{ to } 8 \text{ inches} \quad (1)$$

$$H/R=0.1 \text{ to } 0.8 \quad (2)$$

$$C_1=7/16 \text{ to } \tfrac{3}{4} \text{ inches} \quad (3)$$

$$C_2=3/16 \text{ to } \tfrac{1}{4} \text{ inches} \quad (4)$$

$$C_1/C_2 \quad (5)$$

$$F/R=0.02 \text{ to } 0.1 \quad (6)$$

$$L_H/R=0.02 \text{ to } 0.1 \quad (7)$$

$$L_R/R=0.02 \text{ to } 0.1 \quad (8)$$

$$\Delta=30° \text{ to } 90° \quad (9)$$

$$C_1/R=0.05 \text{ to } 0.3 \quad (10)$$

$$C_2/R=0.01 \text{ to } 0.1 \quad (11)$$

In accordance with the invention, the container is integrally formed from a substantially homogeneous paperboard blank by a press. Preferably, the blank is a unitary, flat piece of paperboard stock conventionally produced by a wet laid papermaking process and typically available in the form of a continuous web on a roll.

The paperboard stock used for the blank preferably has a weight in the range of 100 pounds to 400 pounds per ream (3000 square feet) and a thickness or caliper in the range of about 0.008 inch to 0.050 inch. Paperboard having basis weight and caliper in the lower end of the range may be preferred for ease of forming and economic reasons. Of course, this must be balanced against the lower strength and rigidity obtained with the lighter paperboard. No matter what paperboard is selected, the containers of the invention have greater rigidity than prior containers formed of comparable paperboard.

Preferably, the paperboard of the blank has a density, in basis weight per 0.001 inch of caliper, in the range of 8 to 12.

The paperboard comprising the blank is typically bleached pulp furnish with double clay coating on one side. Preferably, the paperboard stock has a moisture content (generally water) varying from 4.0% to 12.0% by weight. In forming the containers of the invention, the best results are achieved when the blank has a water content by weight of 9% to 11%.

While various end uses for the containers of the invention are contemplated, typically they are used to holding food and liquids. Accordingly, one side of the blank is preferably coated with one or more layers of a known liquid-proof coating material, such as a first layer of polyvinyl acetate emulsion and a second layer of nitrocellulose lacquer. For aesthetic purposes, one side of the blank may be printed with a design or other printing before application of the liquid-proof coatings. It is also preferred that the coatings selected be heat resistant.

Figure 3:
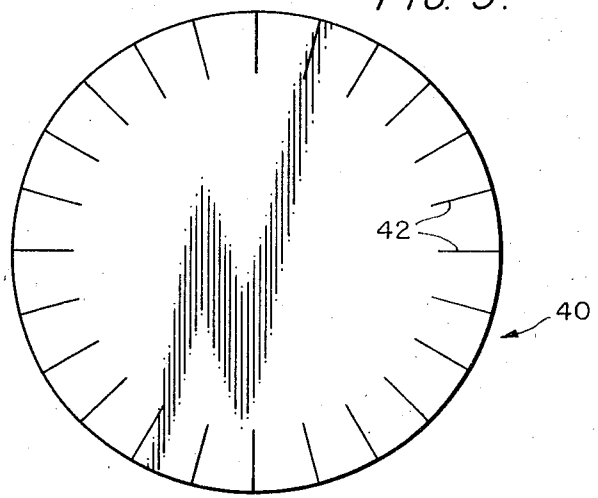
FIG. 3 is a plan view of a blank for a plate-like container of the invention.

Blank 40 depicted in FIG. 3 is the type generally used to form circular containers such as plates and bowls. Preferably the blank includes a plurality of radially extending score lines 42 circumferentially disposed around the periphery of blank 40. The score lines define locations at which pleats are created in the side wall, second curved portion, rim and lip during forming of the container. The number of score lines 42 may vary between 10 and 100 for a circular container depending on the rigidity desired and on the radius R and height H of the container. Generally, the fewer score lines, and therefore, the fewer resulting pleats, the more rigid the resulting container. Significant to this invention, the fewer score lines for a given reduction in radius at the side wall and rim the greater the overlap of paperboard at the pleats which places more fiber in the area of densification. Thus, with appropriate pressure, moisture and temperature conditions, improved bonding of the fiber network is achieved. This can be referred to as pleat bonding. Where the contemplated container is other than circular, score lines are provided in the blank in areas to be formed into annular portions of the container.

The press used to form the container of the invention is preferably an articulated press of the type disclosed in Patterson, U.S. Pat. No. 4,149,841.

The preferred press includes male and female die surfaces which define the shape and thickness of the container. Preferably, at least one die surface is heated so as to maintain a temperature during pressing of the blank in the range of 200° F. to 400° F.

In accordance with the invention, the container is formed by a press such that the thickness of the side wall, second curved portion and rim is less than that of the bottom wall, first curved portion and lip. In the preferred embodiment, the press applies substantially zero pressure to the bottom wall; the thickness of the bottom wall in the resulting container being substantially equal to the blank.

In the preferred embodiment, the ratio of thicknesses of the bottom wall, side wall and rim to the radius of the container or annular portion are in the following ranges:

$$T_o/R=0.002 \text{ to } 0.008 \quad (12)$$

$$T_s/R = 0.001 \text{ to } 0.007 \quad (13)$$

$$T_f/R = 0.001 \text{ to } 0.007 \quad (14)$$

Depending on the embodiment, $T_s$ may equal $T_f$, and it is preferred that $T_s$ and $T_f < T_o$. In some embodiment, due to paperboard weight and press parameters, $T_s$ may be less than $T_f$.

To achieve the preferred thicknesses of the side wall and rim, preferably the press imposes on the side wall, second curved portion and rim a pressure in the range of 300 psi to 1500 psi.

While in the earlier container disclosed in co-pending application Ser. No. 376,880, the distal edge of the lip was subjected to the greatest pressure and had the least thickness, in the present invention it has been found that application of the significant pressure contemplated causes damage to the lip. Furthermore, it has been found that the lip of the container of this invention does not contribute as much to rigidity as does the side wall and rim. Accordingly, in the preferred embodiment, the lip has a thickness greater than the rim or sidewall but somewhat less than the bottom wall.

In accordance with the invention, the container includes a plurality of densified regions radially extending through and circumferentially spaced about annular sections of the side wall, second curved portion and rim. The densified regions are formed from pleats including at least three layers of paperboard created during press-forming of the blank and subjected to sufficient pressure to reform the pleats into cohesive, fibrous structures having a density substantially greater than and a thickness substantially equal to adjacent areas of the side wall, second curved portion and rim.

Figure 4:
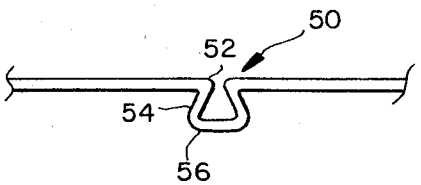
FIG. 4 is a graphic representation of a cross-section of a pleat taken along line IVIV of FIG. 1 before application of pressure to the side wall and rim.

As depicted in FIG. 1, the preferred embodiment of the invention includes a plurality of densified regions 25 radially extending through and circumferentially spaced about the annular section of side wall 14, first curved portion 20, and rim 18. These densified regions are formed from pleats 50, exageratedly represented in FIG. 4, including at least three layers 52, 54, 56 of paperboard created at the score lines during forming of the container. These pleats are subjected to sufficient pressure to reform the fibers of the separate layers 52, 54, 56 of paperboard into a cohesive, fibrous structure.

Reformation of the pleats into cohesive, fibrous structures substantially strengthens the weakest part of a pressed paperboard container. Where the pleats no longer comprise separate layers of paperboard, there is no tendancy for the container to return to its original shape. Indeed, the densified regions resist efforts to flatten the side wall and rim as such would require increasing the area of the side wall and rim.

Preferably, the press forming the container imposes a force in the range of 6000 lbs to 30,000 lbs between the die surfaces.

It will be apparent that if substantially zero pressure is imposed on the bottom wall, virtually all of the force between the dies of the press is imposed on the other areas of the container. To achieve such a distribution of pressure, the preferred die structure provides a spacing between die surfaces at the bottom wall which is substantially equal to or greater than the blank thickness. The die spacings at the side wall, second curved portion, rim and lip are less than the blank thickness. In this way the amount of pressure imposed can be different at different lines of circumference.

Preferably, the spacing between the die surfaces at the side wall is equal to that at the rim, and the spacing at the lip is greater than at the side wall and rim and equal to or less than that of the blank. The die surface spacing at the side wall may be less than that at the rim in some embodiments.

The pressure imposed on the side wall, second curved portion, rim and lip, of course, depends on the respective areas of those regions which will vary with different contemplated shapes and sizes.

For comparison, in a typical 9 inch diameter (after forming) paper plate, a typical force between die surfaces of 6000 pounds if uniformly distributed over the area of the plate results in a pressure of about 90 psi over the entire plate area.

In a 9 inch plate formed as taught in the co-pending application, pressures in the range of 200 psi are imposed on the rim and lip. This is achieved by distributing the die force of about 6000 pounds only over the area of the rim and lip.

In a 9 inch plate formed in accordance with the invention, the side wall, second curved portion and rim receive a pressure in excess of 500 psi thereby substantially increasing the densities of these regions. P During the pressing process, the initial stage defines the basic shape of the container. The bottom wall, side wall, rim and curved portions are formed and the pleats or folds are created in the side wall and rim. At this point only nominal pressure has been applied to the container. As the process continues, pressure is first applied only to the pleats which are raised above the adjacent surfaces. Thus, the full force of the press is distributed over the very small area comprising the pleats thereby imposing an instantaneous pressure on the pleats which is substantially greater than subsequently imposed on the full area of the side wall and rim. Compressing three or more layers of paperboard with such pressure breaks down the fiber matrix of the paperboard and reforms the fibers into a new cohesive, fibrous structure. As the process continues the pleats are reduced in thickness to that of the adjacent side wall and rim, and the force of the press is distributed over a large area. At this point the pressure reduces the thickness of the side wall and rim as well as the newly-formed densified regions to increase the density of the side wall and rim and to further increase the density of the densified regions.

In the example referred to above, the initial pressure imposed on the pleats may be approximately 12,000 psi. Such pressure, in conjunction with press temperature and blank moisture content, disassociates the fibers from their previous structure in the three layers of paperboard and reforms the fibers into a new bonded network constituting a cohesive fibrous structure. Since the die surfaces acting on the side wall, second curved portion and rim are uniform, the densified regions have and retain a thickness substantially equal to that of the annularly adjacent areas. As the densified regions are cohesive structures, they will withstand tension to levels approaching that of pulp molded containers. The resulting containers, while not as strong as pulp molded containers, provide substantially greater rigidity than prior paperboard containers and are very competitive with pulp molded containers because the cost of the containers of the invention is substantially less.

The effect of application of such pressures may be seen in FIGS. 5–8 which are micrographs of cross-sections through a paper plate made in accordance with the present invention. The plate was formed of 160 pound per ream, 0.015 inch caliper, low density bleached plate stock, clay coated on one side, printed on one surface with standard inks and coated with two layers of liquid-proof material. The density of the paperboard stock, in basis weight per 0.001 inch of thickness, averages about 10.7.

Figure 5:
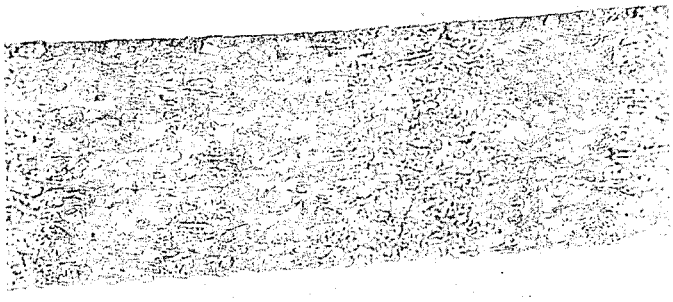
FIG. 5 is a photomicrograph (100x) of a cross-section of the bottom wall portion of a paperboard plate formed in accordance with the invention.
Figure 6:
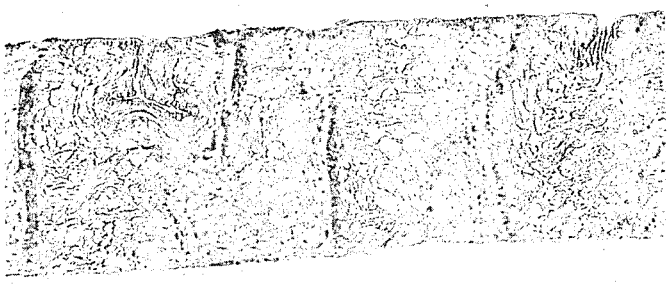
FIG. 6 is a photomicrograph (100x) of a cross-section of a densified region in the side wall of a paperboard plate formed in accordance with the invention.
Figure 7:
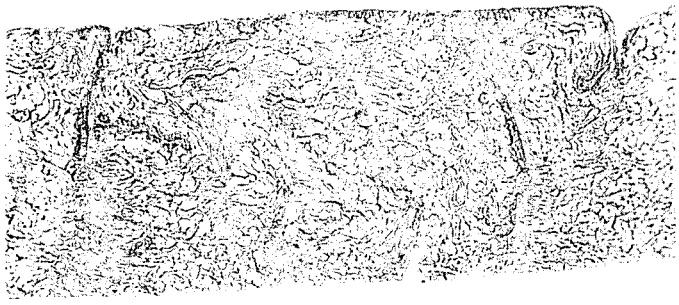
FIG. 7 is a photomicrograph (100x) of a cross-section of a densified region in the rim of a paperboard plate formed in accordance with the invention.

The view of FIG. 5 (100x) is a crosssection through the approximate center of the plate made in accordance with the present invention and shows relatively even surfaces. The fiber network seen in FIG. 5 has evident many ends of round fibers with substantial voids distributed throughout the matrix of fibers within the board which is charactristic of the unpressed, low density paperboard stock material from which the pressed plate is made. The average thickness is about 0.015 inch. FIG. 6 (100x) is a photomicrograph taken along a cut through the side wall of the plate, with the cut lying along a circumferential line through one of the densified regions of the pressed plate. FIG. 7 (100x) is a photomicrograph taken along a cut through the rim of the plate, the cut lying along a circumferential line through one of the densified regions. The paperboard in the area through which the sections of FIG. 6 and 7 were taken is highly compacted, leaving very little empty space between the fibers; the structure of the densified region consists of compressed bonded fibers. The paperboard in the lip shown in FIG. 8 has been slightly compacted compared to the bottom wall shown in FIG. 5, but since it has been subjected to less pressure than the side wall and rim seen in FIGS. 6 and 7, the pleat structure is more apparent.

The thickness of the cross-sections, occurring at the densified regions shown, is about 0.012 inch at the side wall (FIG. 6) and 0.013 inch at the rim (FIG. 7), substantially less than the thickness (0.015 inch) of the bottom wall (FIG. 5). Away from the densified regions the thickness of the side wall and rim is about the same as the densified regions and thinner than the bottom wall. Since the densified regions contain substantially more solid fibrous material than the rest of the paperboard; perhaps 40 to 100% more, the density of the densified regions is substantially greater than the remainder of the container.

Figure 8:
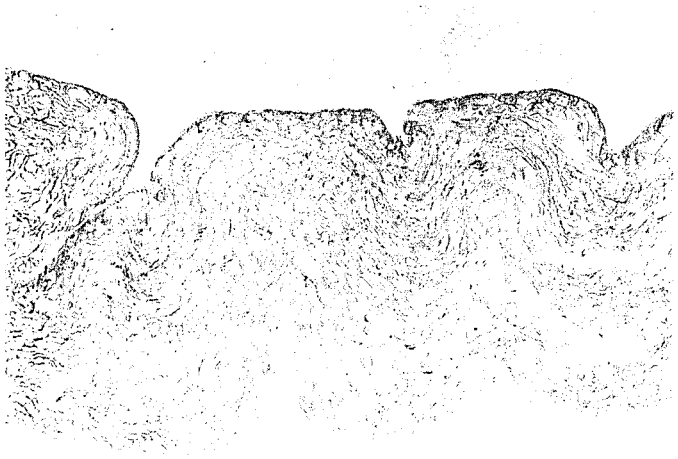
FIG. 8 is a photomicrograph (100x) of a cross-section of a pleat in the lip of a paperboard plate formed in accordance with the invention.

The surface of the paperboard of FIGS. 6 and 7 are essentially smooth and continuous. The uneven surfaces seen in FIG. 8 are similar to the appearance of pleats in the rim and side wall regions prior to the application of high pressure. As seen in FIGS. 6 and 7, such pressure has caused virtually all traces of the pleat to disappear and the paperboard fibers have been essentially bonded together, leaving only the vestigial traces of the fold remaining. Strength measurements (tension within the elastic limit of the densified region) indicate a strength of at least twice and up to five times that of containers formed with lower pressures. The heat and pressure applied during the forming process may be sufficient to cause some melting and surface adhesion between the abutting coated surfaces which lie along the fold lines, although the outer coating is preferably resistant to heat and pressure.

The cross-sections through a plate of the invention take across the side walll and rim, FIGS. 6 and 7, shows that the fibers within the plate are substantially compacted, and virtually all evidence of the pleats that existed in the side wall and rim areas during the forming operation have disappeared, except for small areas where the overcoated tops of the folded regions have been laid back upon themselves. The fibers are tightly and closely compressed together, leaving very few voids or air spaces, and the basis weight of the paperboard in these regions are substantially uniform because of the compaction of the fibers. The densification of the plate in the side wall and rim areas and the reformation of the pleats into substantially integral structures results in the marked increases in plate rigidity.

Due to the photomicrographic process used to produce FIGS. 5–8, certain discoloration and focus abnormalities appear. These problems are particularly evident in FIG. 6 wherein dark lines and blurred areas appear. These areas of FIG. 6, and to some extent in FIG. 7, are not intended to represent structural aspects of the pressed fiberboard and may be ignored.

Containers formed in accordance with the invention have much greater rigidity than comparable containers formed of similar paperboard blank material in accordance with the prior art processes. To provide a comparison of the rigidity of various plates formed in the configuration of the plate 10, a test procedure has been used which measures the force that the plate exerts in resistance to a standard amount of deflection. The test fixture utilized, a Marks II Plate Rigidity Tester, has a wedge shaped support platform on which the plate rests. A pair of plate guide posts are mounted to the support platform at positions approximately equal to the radius of the plate from the apex of the wedge shaped platform. The paper plate is laid on the support platform with its edges abutting the two guide posts so that the platform extends out to the center of the plate. A straight leveling bar, mounted for up and down movement parallel to the support platform, is then moved downwardly until it contacts the top of the rim on either side of the plate so that the plate is lightly held between the platform and the horizontal leveling bar. The probe of a movable force gauge, such as a Hunter Force Gauge, is then moved into position to just contact the top of the rim under the leveling bar at the unsupported side of the plate. The probe is lowered to deflect the rim downwardly one-half inch, and the force exerted by the deflected plate on the test probe is measured. For typical prior commercially produced 9 inch paper plates, rigidity readings made as described above generally averaged about 60 grams or less (using the Hunter Force Gauge), and the plate as shown in copending application, serial number 367,880, had an average rigidity of about 90 grams/0.5 inch deflection. A comparable 9 inch plate produced in accordance with the invention has rigidity in the range of 140 gms to 280 gms/0.5 inch deflection depending on the paper weight used and the number of score lines.

Of course, successful manufacture of containers in accordance with the invention requires attention to details of the pressing process in accordance with good manufacturing techniques. For example, the die surfaces of the press preferably would be perfectly symmetrical around the entire circumference. This not being entirely practical in view of machining requirements, the critical tolerances are those within the side wall, second curved portion and rim areas. It is highly preferred that the die spacings in these areas be uniform along any circumferential line. Additionally, it is necessary that male and female die surfaces be properly aligned.

It is understood that the invention is not confined to the particular construction and arrangement or to the particular process techniques described herein; the invention includes modified forms thereof within the scope of the following claims.

I claim:

1. A paperboard container, comprising:

(a) a bottom wall, an upwardly extending side wall, a first curved portion joining said side wall to the periphery of said bottom wall, an outwardly extending rim, and a second curved portion joining said rim to the periphery of said side wall;

(b) said container being integrally formed from a substantially homogeneous paperboard blank by a press such that the thickness of said side wall, second curved portion and rim is less than that of said bottom wall and first curved portion; and (c) a plurality of densified regions radially extending through and circumferentially spaced about annular sections of said side wall, second curved portion and rim, said densified regions being formed from pleats including at least three layers of said paperboard reformed into substantially integrated, fibrous structures being generally inseparable into their constituent layers and having a density substantially greater than and a thickness substantially equal to circumferentially adjacent areas of the side wall, second curved portion and rim.

2. The paperboard container of claim 1 wherein said bottom wall is generally co-planar with an imaginary plane defined by its periphery.

3. The paperboard container of claim 1 wherein said bottom wall gradually diverges toward its center from an imaginary plane defined by its periphery.

4. The paperboard container of claim 3 wherein the center of said bottom wall is lower than its periphery.

5. The paperboard container of claim 3 wherein the center of said bottom wall is higher than its periphery.

6. The paperboard container as in claim 2 wherein said rim extends in a plane generally parallel to said imaginary plane.

7. The paperboard container of claim 1 wherein the radial distance R from the center of the bottom wall to the distal end of the rim is in the range of 2 to 8 inches.

8. The paperboard container of claim 7 wherein the ratio of axial height (H) of the rim above the plane of the periphery of the bottom wall to R is in the range of 0.1 to 0.3.

9. The paperboard container of claim 7, wherein the ratio of the radial width (F) of the rim to R is in the range of 0.04 to 0.1.

10. The paperboard container of claim 7, wherein the ratio of the axial height ($L_H$) of the rim to R is in the range of 0.02 to 0.06.

11. The paperboard container of claim 1, wherein the thickness ($T_o$) of the bottom is substantially equal to the thickness of said blank.

12. The paperboard container of claim 7, wherein the ratio of the bottom wall thickness ($T_o$) to R is in the range of 0.002 to 0.008.

13. The paperboard container of claim 7 wherein the ratios of the side wall thickness ($T_s$) to R and the rim thickness ($T_f$) to R are in the range of 0.001 to 0.007.

14. The paperboard container of claim 13, wherein $T_s/T_o$=0.5 to 0.95 and $T_f/T_o$=0.5 to 0.95.

15. The paperboard container of claim 1, wherein said blank has a basis weight in the range of 100 pounds to 400 pounds per 3,000 square feet and a thickness in the range of 0.010 inch to an 0.050 inch.

16. The paperboard container of claim 1, wherein said blank has a moisture content in the range of 4% to 12% by weight.

17. The paperboard container of claim 15, wherein said blank has a moisture content in the range of 9% to 11% by weight.

18. The paperboard container of claim 1, wherein said blank has a density, in basis weight per 0.001 inch of thickness, in the range of 8 to 12.

19. The paperboard container of claim 1 wherein said blank includes a plurality of radially extending score lines circumferentially spaced about the periphery thereof, said score lines causing creation of said pleats during press forming of said container.

20. The paperboard container of claim 19, wherein said blank includes 10 to 100 score lines equally spaced about its periphery.

21. The paperboard container of claim 1 also including a downwardly curved lip outwardly extending from the periphery of said rim.

22. The paperboard container of claim 21 wherein the thickness of said lip is greater than the thickness of said rim.

23. The paperboard container of claim 21 wherein the ratio of the radial width of the lip ($L_R$) to the radial distance (R) from the center of the bottom wall to the distal edge of the lip is in the range of 0.02 to 0.06.

24. A paperboard container, comprising:

(a) A generally planar bottom wall having a thickness $T_o$=0.15 to 0.22 inches;

(b) an upwardly extending, generally planar side wall having a thickness $T_s$=0.11 to 0.20 inch;

(c) a first curved portion joining said side wall to the periphery of said bottom wall and having a radius of curvature $C_1$=7/16 to ¾ inch;

(d) an outwardly extending, generally planar rim having a radial width F and a thickness $T_f$, said rim being substantially parallel to said bottom wall and being axially spaced from the periphery of said bottom wall a distance H;

(e) a second curved portion joining said rim to the periphery of said side wall and having a radius of curvature $C_2$=3/16 to ¼ inch;

(f) a downwardly curved lip outwardly extending from the periphery of said rim, said lip having an axial height $L_h$ and a radial width $L_r$, the distal periphery of said lip being radially spaced from the center of said bottom wall a distance R;

(g) said container conforming to the realtionships $$H/R=0.1 \text{ to } 0.6; \quad (1)$$

$$L_h/R=0.02 \text{ to } 0.1; \quad (2)$$

$$L_r/R=0.02 \text{ to } 0.1; \quad (3)$$

$$F/R=0.02 \text{ to } 0.1; \quad (4)$$

$$C_1/R=0.05 \text{ to } 0.3; \quad (5)$$

$$C_2/R=0.01 \text{ to } 0.1; \quad (6)$$

$$T_o/R=0.003 \text{ to } 0.006; \quad (7)$$

$$T_s/R=0.002 \text{ to } 0.005; \quad (8)$$

$$T_f/R=0.002 \text{ to } 0.005; \text{ and} \quad (9)$$

(h) a plurality of densified regions radially extending through and circumferentially spaced about said side wall, second curved portion and rim, said densified regions including at least three layers of paperboard reformed into substantially integrated, fibrous structures being generally inseparable into their constituent layers and having a density substantially greater than and a thickness generally equal to circumferentially adjacent areas of said side wall, second curved portion and rim.

25. A paperboard container, comprising:

(a) a substantially planar bottom wall, an upwardly extending substantially planar side wall, a first curved portion joining said side wall to the periphery of said bottom wall, an outwardly extending, substantially planar rim being substantially parallel to said bottom wall, a second curved portion joining said rim to the periphery of said side wall, and a downwardly curved lip outwardly extending from the periphery of said rim;

(b) said side wall, second curved portion and rim having a thickness less than that of said bottom wall, first curved portion and lip; and (c) a plurality of densified regions radially extending through and circumferentially spaced about annular portions of said side wall, second curved portion and rim, said densified regions including at least three layers of paperboard reformed into substantially cohesive, fibrous structures being generally inseparable into their constituent layers and having a density substantially greater than and a thickness substantially equal to circumferentially adjacent areas of said side wall, second curved portion and rim.

26. The paperboard container of claim 25 wherein the dimensions of said container conform to the relationships $$H/R = 0.1 \text{ to } 0.8,$$

wherein R is the radial distance between the center of said bottom wall and the distal periphery of said lip and H is the axial height between said rim and the periphery of said bottom wall.

27. The paperboard container of claim 25 wherein the dimensions of said container conform to the relationships $$T_o/R = 0.002 \text{ to } 0.008,$$

$$T_s/R = 0.001 \text{ to } 0.007,$$

$$T_f/R = 0.001 \text{ to } 0.007,$$

wherein R is the radial distance between the center of said bottom wall and the distal periphery of said lip, $T_o$ is the average thickness of said bottom wall, $T_s$ is the average thickness of the side wall, and $T_f$ is the average thickness of the rim.

* * * * *

UNITED STATES PATENT AND TRADEMARK OFFICE

CERTIFICATE OF CORRECTION

PATENT NO. : 4,606,496

DATED : AUGUST 19, 1986

INVENTOR(S) : RONALD P. MARX ET AL.

It is certified that error appears in the above-identified patent and that said Letters Patent is hereby corrected as shown below:

Title page:

Please correct the spelling of the inventors names to correctly read:

[75] Inventors: Ronald P. Marx, Lakewood
Patrick H. Wnek, Menasha
Denny R. Garns, Appleton
All of Wisconsin Column 5, line 41, "$C_1/C_2$" should read

--$C_1 > C_2$--

Signed and Sealed this

Nineteenth Day of April, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,606,496
DATED : August 19, 1986
INVENTOR(S) : Ronald P. Marx etal.

It is certified that error appears in the above-identified patent and that said Letters Patent is hereby corrected as shown below:

Claim 24, Column 12, line 27, change "0.15 to 0.22" to read --0.015 to 0.022--;
Column 12, line 29, change "0.11 to 0.20" to read --0.011 to 0.020--.

Signed and Sealed this

Twelfth Day of December, 2000

*Attest:*

Q. TODD DICKINSON

*Attesting Officer*

*Director of Patents and Trademarks*

US004606496C1

(12) REEXAMINATION CERTIFICATE (4551st)

United States Patent

Marx et al.

(10) Number: US 4,606,496 C1

(45) Certificate Issued: Apr. 9, 2002

(54) RIGID PAPERBOARD CONTAINER

(75) Inventors: Ronald P. Marx, Lakewood; Patrick H. Wnek, Menasha; Denny R. Grans, Appleton, all of WI (US)

(73) Assignee: Fort James Corporation, Richmond, VA (US)

Reexamination Request:
No. 90/006,033, Jun. 11, 2001

Reexamination Certificate for:

| | |
|---|---|
| Patent No.: | **4,606,496** |
| Issued: | **Aug. 19, 1986** |
| Appl. No.: | **06/777,873** |
| Filed: | **Sep. 20, 1985** |

Certificate of Correction issued Apr. 19, 1988.

Certificate of Correction issued Dec. 12, 2000.

Related U.S. Application Data

(63) Continuation of application No. 06/591,557, filed on Mar. 20, 1984, now abandoned.

(51) Int. Cl.[7] ..... B65D 1/00; B65D 1/34

(52) U.S. Cl. ..... 229/406; 220/574

(58) Field of Search ..... 220/574; 229/406, 229/407

(56) References Cited

FOREIGN PATENT DOCUMENTS

| | | |
|---|---|---|
| GB | 981667 | 1/1965 |
| JP | S51-148583 | 12/1976 |
| JP | 52-17271 | 2/1977 |
| JP | S56-48300 | 11/1981 |

*Primary Examiner*—Stephen P. Garbe

(57) ABSTRACT

This invention is a paperboard container comprising a bottom wall, an upwardly extending side wall, a first curved portion joining the side wall to the periphery of the bottom wall, an outwardly extending rim, a second curved portion joining the rim to the periphery of the side wall, and a downwardly curved lip outwardly extending from the periphery of the rim. The container is integrally formed from a substantially homogeneous paperboard blank by a press such that the thickness of the side wall, second curved portion and rim is less than that of the bottom wall, first curved portion and lip. The container includes a plurality of densified regions radially extending through and circumferentially spaced about annular sections of the side wall, second curved portion and rim. The densified regions are formed from pleats including at least three layers of paperboard created during press forming of the blank which are subjected to sufficient pressure to reform the pleats into cohesive, fibrous structures having a density substantially greater than and a thickness substantially equal to adjacent areas of the side wall, second curved portion and rim.

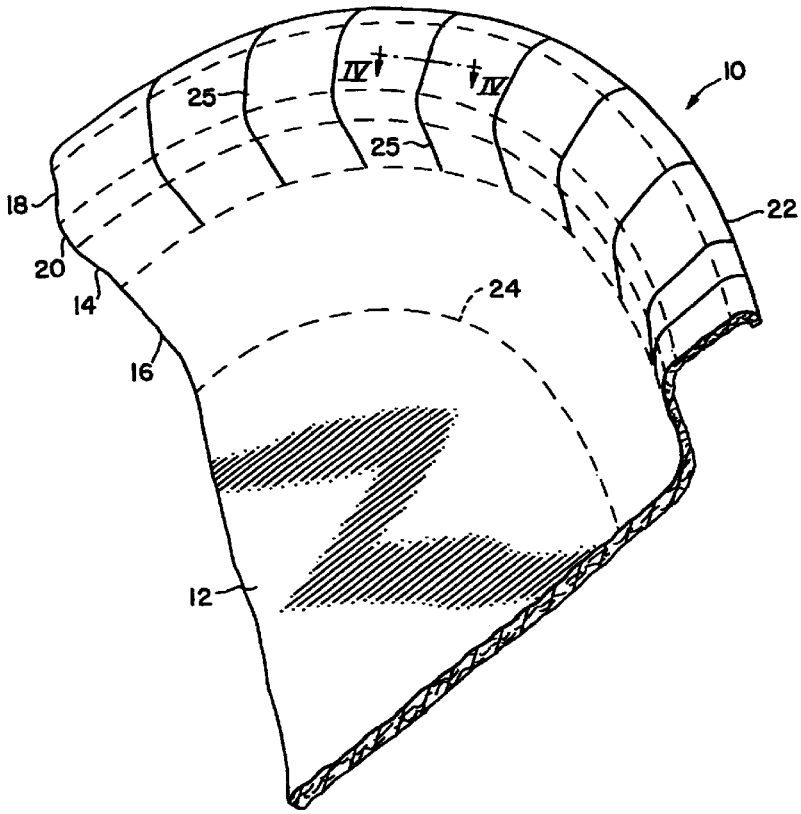

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–27 is confirmed.

* * * * *